United States Patent [19]

Scheidweiler

[11] 4,058,803

[45] Nov. 15, 1977

[54] DUPLEX IONIZATION-TYPE FIRE SENSOR

[75] Inventor: Andreas Scheidweiler, Stafa-Uerikon, Switzerland

[73] Assignee: Cerberus AG, Mannedorf, Switzerland

[21] Appl. No.: 666,645

[22] Filed: Mar. 15, 1976

[30] Foreign Application Priority Data

Feb. 6, 1976 Switzerland ..... 1469/76

[51] Int. Cl.[2] ..... G08B 17/10

[52] U.S. Cl. ..... 340/237.5; 250/381

[58] Field of Search ..... 340/237.5; 250/381, 250/382, 384, 385, 389

[56] References Cited

U.S. PATENT DOCUMENTS

| | | | |
|---|---|---|---|
| 2,994,768 | 8/1961 | Derfler | 340/237.5 X |
| 3,717,862 | 2/1973 | Sasaki | 340/237.5 |
| 3,728,706 | 4/1973 | Tipton et al. | 340/237.5 |
| 3,775,616 | 11/1973 | Tagashira et al. | 340/237.5 X |

*Primary Examiner*—John W. Caldwell, Sr.

*Assistant Examiner*—Daniel Myer

*Attorney, Agent, or Firm*—Flynn & Frishauf

[57] ABSTRACT

Two ionization chambers are formed on the sensor, one including a pair of electrodes and ionizing substance, which are relatively so located that, in the space between the electrodes, the air will be ionized with both positive and negative ions so that the current flowing between the electrodes will be generated by ions of both polarities to form a bipolar ionization chamber; the other has the electrodes and the ionizing substance so located that at least in a portion, preferably a major portion of the space between the electrodes, ions of only a single polarity will occur. The bipolar chamber is shielded from air flow therethrough, the unipolar chamber, however, being exposed to free air flow. Preferably, a third or reference chamber may be combined with the sensor. The unipolar and bipolar chambers are connected to an evaluation circuit which responds when the current between the electrodes in at least one of the unipolar or bipolar chambers drops below a certain threshold value.

12 Claims, 6 Drawing Figures

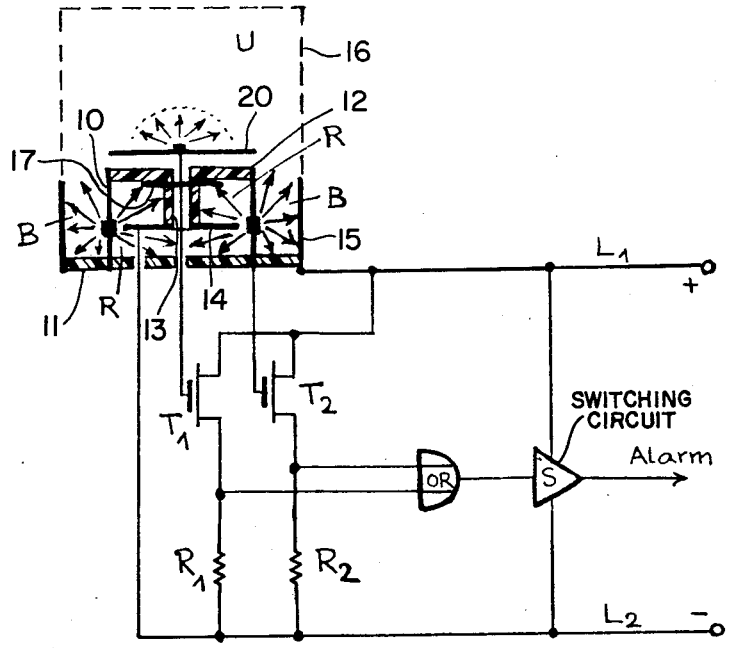
Fig. 3
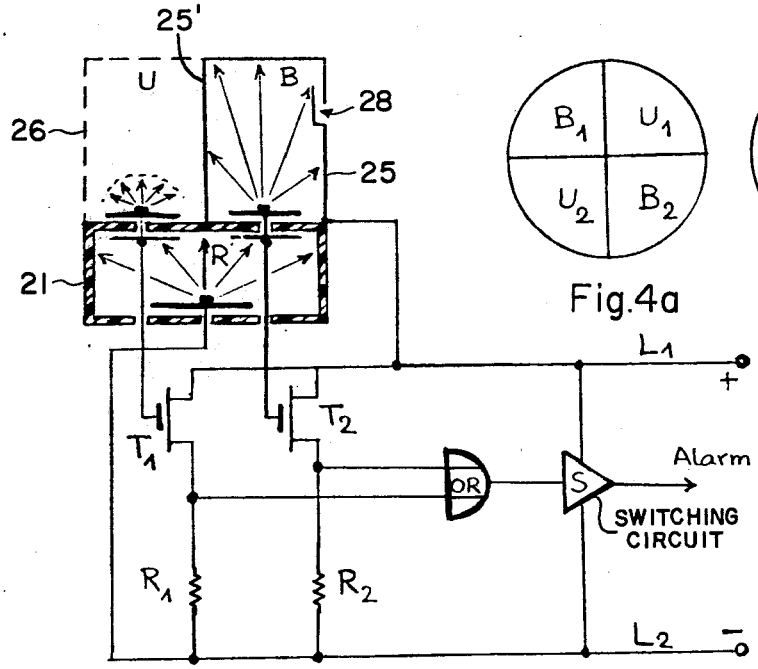
Fig.4a
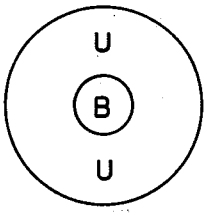
Fig.4b
Fig.4

DUPLEX IONIZATION-TYPE FIRE SENSOR

CROSS REFERENCE TO RELATED PATENTS AND APPLICATION

U.S. Pat. Nos. 2,994,768; 2,963,600; 3,233,100; 3,559,196; 3,710,110; 3,909,813; and U.S. patent application Ser. No. 666,644, filed Mar. 15, 1976, Scheidweiller all assigned to the assignee of the present application.

The present invention relates to an ionization-type smoke and fire detector using an ionization chamber having two electrodes and means to ionize the air in the chamber, that is, in the space between the electrodes, the electrodes being connected to a utilization circuit which provides an alarm when the ionization current between the electrodes drops, that is, when the reflected resistance of the chamber exceeds a predetermined threshold value.

Smoke and fire detectors using ionization chambers operate on the basis that smoke particles, fire aerosols and the like will capture ions in the chamber and thus decrease the ion current flow between the electrodes; in other words, the resistance of the ionization chamber increases. Such smoke and fire detectors have the advantage that they are capable not only of indicating the presence of visible smoke but also respond to fire aerosols. Fire aerosols arise in the early stage of a fire and do not lead to attenuation of light transmission through the air in which they appear. Fire and smoke sensors which operate based on attenuation of light in a light path, or dispersion of light, are capable of responding only if visible smoke appears. This is a disadvantage of such sensors with respect to ionization-type sensors. Ionization-type sensors responding to fire aerosols permit initiation of alarms promptly after a fire has started.

The ion current between the electrodes in the ionization chamber of an ionization-type smoke or fire detector does not depend on the density of smoke or aerosols in the chamber alone. The ion current additionally depends on the speed of flow of air through the ionization chamber. This is a disadvantage of the ionization-type fire sensor. The influence of speed of air flow through the chamber is particularly apparent in sensors operating with very low electrical fields in the ionization chamber, that is, with low-voltage type ionization smoke or fire detectors. Such low-voltage units have been found particularly suitable, and it is especially in such units that the influence of speed of air flow is troublesome. It is possible even that external air movements reduce the ion current, depending on the construction and design of the chamber. As a result, as air flows through the chamber of the sensor, the sensor becomes more and more sensitive until the air speed will have a value which is so high that the current is reduced to the point where the alarm system will respond, resulting in a false alarm. The sensor may, therefore, respond without the presence of smoke or fire in the chamber. Some constructions, however, are arranged so that the ion current will increase with increasing air speed therethrough, so that the sensor becomes less and less sensitive and will not react to the presence of smoke or fire aerosols at all.

To prevent erroneous indications which are particularly serious in fire sensors, where false alarms should be avoided with as much assurance as the issuance of alarms if a fire is actually present, it has previously been proposed to shield ionization smoke and fire detectors to prevent drafts and air currents from arising therein and falsifying the response thereof. These shields, baffles or shrouds were so arranged that air, contaminated with smoke, smoke or fire aerosols, could penetrate into the chamber only with reduced air flow speed. A windshield or baffle can be arranged, for example, by suitably shaping the wall of the chamber, by providing additional shields, by carefully thought-out location of air entrance and exit openings, or by shaping the electrodes in such a way that air entering the chamber is suitably slowed.

Smoke or fire detectors having such shielded ionization chambers respond excellently when an open fire arises since this is always accompanied by some air circulation, so that smoke, smoke and fire aerosols and the like can penetrate into the chamber with sufficient speed to ensure rapid alarm response of the sensor. In smouldering fires, however, in which there is hardly any movement of air, smoke and fire aerosols will not penetrate the ionization chamber, if the entry is baffled with sufficient rapidity so that the issuance of an alarm, under unfortunate circumstances, can be unduly delayed. The baffles or shields preventing rapid air flow can also prevent entry of smoke and fire aerosols if there is very little, if any, air flow.

It is an object of the present invention to provide an ionization-type smoke or fire sensor which does not have the disadvantages above referred to and which provides an alarm signal promptly, regardless of the type of fire to which it is exposed; and yet, which is essentially immune to providing false alarms.

Subject matter of the present invention: Briefly, the sensor has two ionization chambers, each of which includes means to ionize the air in such a way that in the space between the electrodes of the ionization sensor, an ion current may flow. One of the ionization chambers is so arranged that the space between the electrodes is ionized with ions of both polarities; this will be referred to as the bipolar chamber. This chamber includes means to slow penetration of air streaming thereinto. The second ionization chamber has essentially free access to air; the means to ionize the air are so arranged and formed that at least a portion of the space between the electrodes will have ions of only one polarity present therein; this will be referred to as the unipolar chamber. An evaluation circuit is connected to both the chambers and so arranged that it provides an output signal if the resistance of at least one of the two chambers rises above a predetermined threshold value.

The invention will be described by way of example with reference to the accompanying drawings, wherein:

FIG. 3 is another embodiment of the sensor combined with a reference chamber;

FIG. 4 illustrates yet another embodiment of a sensor having a reference chamber;

FIG. 4*a* is a top view of a sensor construction, generally similar to the sensor of FIG. 4, but having four air-responsive chambers; and FIG. 4*b* is a top view of another chamber arrangement of a sensor, generally similar to FIG. 4.

A smoke detector sensor M1 is connected to supply and sensing lines L1 and L2, connected to a source of positive and negative voltage at a central alarm station C. Further similar or other sensors may be connected, as schematically shown by the sensor M2.

The ionization sensor M1 (FIG. 1) has two ionization chambers U and B, respectively. Both chambers, each, have a center electrode on which a radiocative substance is applied. The housing or outer cover of each chamber forms the counterelectrode. Ionization chamber U has a housing or outer cover which is highly transparent to air flow, for example formed as a grid or mesh of thin wires, so that ambient atmosphere has essentially free access to the interior of the chamber, while foreign bodies, insects, and the like, are excluded. The other ionization chamber B is formed with a housing which is shaped to form an air flow baffle so that the interior of the chamber will be essentially impervious to transverse air flow, and which has small entry openings for the ingress of air, which may be so arranged, for example, that air can enter the chamber only after deflection, or in a tortuous, sinuous path, so that air flow through the chamber is baffled to be effectively slowed or braked. As a result, ambient atmosphere may penetrate rapidly into the ionization chamber U even if the speed of movement of the atmosphere is only very low. The ionization chamber B, however, is so constructed that, although air flow thereto may be at substantial speed, only slight air movement will occur within the chamber itself.

In addition to the outer construction of the housing defining the chamber, that is, the elements which control air flow therethrough, or thereinto, an additional difference characterizes the two chambers. This difference is related to the type of ionization occurring within the interior of the chamber, that is, in the space between the electrodes. Ionization chamber B has a radioactive source of radiation located at a suitable point, for example in the center of the electrode, which is characterized in that it has a radiation range which extends throughout essentially the distance of the radioactive source to any point of the counter-electrode, so that, for practical purposes, the entire interior of the chamber is ionized. Substantially the entire space between the electrodes, therefore, will have ions of both polarities occur therein. The ions of both polarities generated between the electrodes will cause a bipolar ion current to flow between the electrodes.

Figure 1:
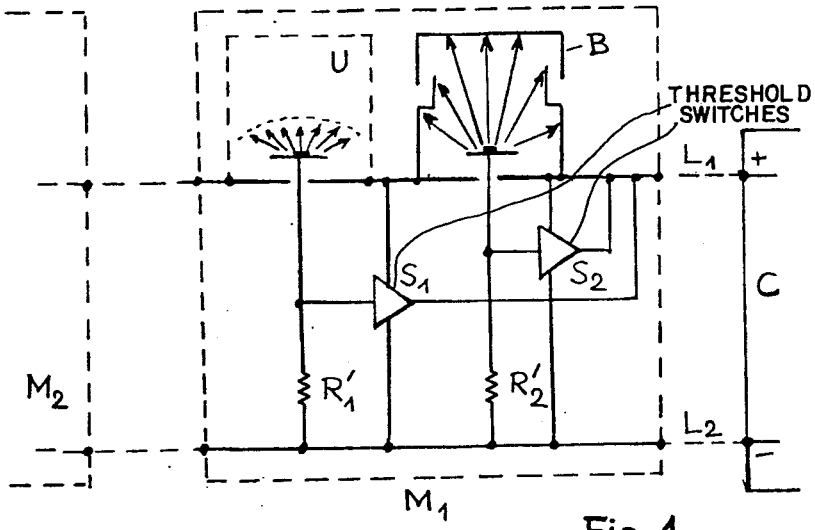
FIG. 1 is a highly schematic diagram of the sensor with a utilization circuit.

Ionization chamber U has a radioactive ionization element placed therein which is so selected and located that only a small portion of the range between the electrodes will be ionized. Thus, effectively, only a small portion of the interior of the chamber is ionized. Ions of both polarities will be generated in this range only; due to the applied voltage between the electrodes, however, that is, due to the voltage between lines L1 and L2, ions will be pulled out o the ionization region. It is the electric field which causes the ion current flow and which, effectively, provides suction to the ions of respective polarity. Effectively, therefore, ions of one polarity only will fill the remainder of the ionization chamber, that is, that portion which is not directly ionized by the ion generating source applied to one electrode. This range, which will have only ions of one polarity occur therein, will have a unipolar ion current flowing therethrough. The unipolar characteristic for one ionization chamber can be obtained in various ways. In FIG. 1, a radiation source is applied to an electrode which is so arranged that the range of radiation is much less than the distance between the electrodes, that is, between the fixed electrode and the outer mesh. A radioactive substance with only short radiation range can be used, for example a source using tritium. The range of radiation sources customary in ionization-type smoke and fire detectors, for example americium 241, can be reduced by suitable shielding thereof, particularly with respect to the other electrode. The source can also be arranged on the electrode to which it is applied at the lateral side, or be so shielded or baffled that only a portion of the space between both electrodes can and will be ionized.

The present invention utilizes the discovery that, although both types of ionization chambers, that is, chambers B and U have a similar response to the presence of fire or smoke aerosols in the interior of the chamber, their reactions to air flow, winds or drafts within the chamber are substantially different. Upon the presence of fire or smoke aerosols, ion current will decrease, which is, effectively, an increase in impedance, primarily resistance of the chamber. In the bipolar chamber B, winds or flow of air will carry off the ions of both polarities from the interior of the chamber. Thus, air flow will result in a decrease in current and, if sufficiently rapid may simulate the same effect as penetration of smoke or fire aerosols and provide a false alarm. The sensor is very sensitive to such air flow and, therefore to prevent false alarms, is shielded or baffled to prevent air currents therein so that decrease of ion current will be due only to smoke or fire. In contrast, air flow through the unipolar chamber U will cause a decrease in the space charge due to the air movement. Thus, upon slight air movement — up to a certain limit — ion current will increase. Upon increased air speed, for example due to turbulence and the like, the unipolar ionization region will be effectively destroyed and the chamber U will then have a characteristic which is similar to that of the bipolar chamber B, that is, current will decrease.

Upon the presence of air or atmospheric currents, an unshielded bipolar ionizaion chamber will first exhibit a decrease in current flow; this decrease in current flow will continue until the chamber will trigger a false alarm. In contrast, however, the ion current in the unipolar chamber would rise, so that the ionization sensor with such characteristic would become insensitive to the presence of smoke or fire aerosols.

Combining both chambers in a single sensor M1 with differential shielding or baffling with respect to air currents results in a combination of the characteristics in a way which effectively excludes false alarms while still providing high sensitivity both to open fires as well as to smouldering fires in which there is only slight thermal air movement. Open fires with strong air movements and drafts, as well as smouldering fires therefore can be detected rapidly and reliably, while excluding false alarms.

Both ionization chambers U and B are serially connected with resistors $R'_1$ and $R'_2$ between the supply lines L1 and L2, respectively. The connecting points of the ionization chambers with the resistors are connected to the inputs of respective threshold switches S1 S2, the outputs of which are connected to the line L1. If the ionization current in one of the two chambers drops below a certain threshold value, then the respective threshold switch S1 or S2 provides a substantially increased line current over the lines L1, L2 to the central station, indicative of alarm conditions, so that the central station C can provide an alarm signal.

In case of a smouldering fire, smoke or smoke and fire aerosols are rapidly emitted to the surrounding atmosphere and can rapidly enter the ionization chamber U which is open to the atmosphere. Upon sufficient density of smoke or smoke or fire aerosols, threshold switch S1 will provide an alarm signal. The bipolar ionization chamber B will not be triggered under those conditions, since the slight atmospheric movement does not permit entry of contaminants into the chamber due to the baffling or shielding effect of its housing construction. In case of an open fire, however, which is usually accompanied by strong atmospheric movements, smoke can relatively rapidly enter both ionization chambers U and B. Due to the rapid movement of atmosphere within the chamber of sensor U, sensor U becomes insensitive to the smoke; due to the shielding effect, however, of the chamber of sensor B, sensor B will retain its sensitivity and will respond. These shields may even improve the sensitivity of the sensor B. In any event, upon occurrence of a predetermined density of aerosols or smoke within the chamber of sensor B, the resistance of the sensor will change to such an extent that the respective threshold switch S2 will respond to provide an alarm output signal. Either a smouldering fire as well as an open fire will provide an alarm, and more rapidly than with known ionization-type sensors. The disadvantages of either of the two types of the ionization sensors are avoided, or compensated by the other sensor; the open fire, causing increasing atmospheric distrubance and flow causes continuously decreasing sensitivity of the unipolar ionization sensor U until it becomes effectively insensitive to fire or smoke aerosols; on the other hand, the sensor B is effectively insensitive to smouldering fires and other fires which are accompanied by little atmospheric movement due to its baffles and shields which are necessary to retain its sensitivity. The combined unit, responding to a response condition of either sensor, however, will provide reliable indication without being subject to false alarms to a greater extent than previously known and used ionization sensors, since the bipolar sensor element or chamber B can be shielded against atmospheric flow.

Figure 2:
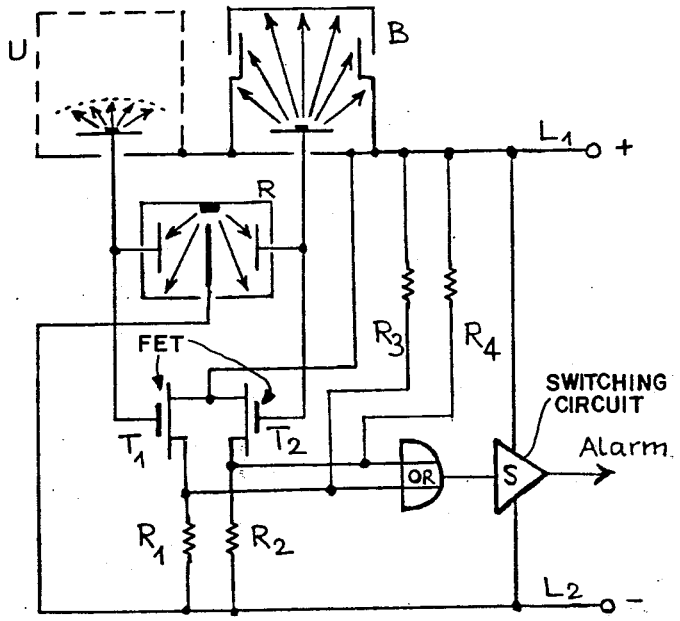
FIG. 2 illustrates another embodiment of the sensor and utilization circuit, combined with a reference chamber.

Embodiment of FIG. 2: The series resistors $R'_1$ and $R'_2$ of FIG. 1 are replaced in this embodiment by an essentially closed reference ionization chamber R; it is so arranged that it does not react to smoke aerosols, for example by being essentially completely shielded with respect thereto. This reference ionization chamber R can be operated in saturation conditions, exposed to ambient atmosphere only by extremely small openings, permitting balancing or equilization of atmospheric pressure but effectively preventing penetration of smoke particles, or at least effectively interfering with such penetration.

An ionization path of the reference ionization chamber R is serially connected to the unipolar chamber U; another ionization path is serially connected to the bipolar chamber B, the active chambers U and B, as well as the reference chamber R having one electrode, each, connected to respective lines L1 and L2. The junction between the active chambers U, B and the respective ionization chamber paths are connected to the control electrodes of a respective field effect transistor (FET) T1, T2. One of the electrodes of the FET's is connected to line L1 and the other electrode to the tap point of a respective voltage divider formed of resistors R1, R3 and R2, R4, respectively. The FET's operate as threshold switches, that is, as soon as their control voltages, as determined by the ion current in the chambers U and B, respectively, drops below the threshold voltage as determined by the reference voltage at the tap or junction point formed by the respective voltage divider is exceeded in negative direction, the respective transistor becomes conductive. The output terminals of these circuits, that is, the junctions of the respective voltage dividers, which are also connected to the electrodes of the respective FET's are connected to the inputs of an OR-gate, the output of which will have a signal appear thereat as soon as one of the two transistors T1 or T2 has become conductive, indicative that one of the two ionization chambers U or B had an increase in resistance, or a decrease in current flow therethrough due to penetration of smoke or fire aerosols thereinto. The output of OR-gate OR is connected to a switching circuits, for example to a thyristor, an electronic switch, or the like, which provides an alarm signal over lines L1, L2 or over a separate alarm line, as soon as one of the sensors U, B has responded.

Embodiment of FIG. 3: The three ionization chambers U, B and R are joined together into one mechanical unit. The upper portion forms the chamber U and is separated from ambient atmosphere only by a thin wire mesh or screen, permitting free air circulation to the ionization region. The ionization source applied to the center of the center electrode ionizes only a small region of the space within the chamber U, so that a voltage applied between the grid or mesh and the center electrode will cause an essentially unipolar ion current to flow. The lower portion of the sensor is shielded against ambient atmosphere by a cylindrical solid outer wall. A further cylinder is located in the interior thereof. This cylinder 10 is supported on an insulating bottom 11, for example of circular outline, and is closed off at the top by a top disk 12, likewise of insulating material, which has an internally extending axial stub 13. The stub 13 supports a bottom disk 14 extending diametrically almost up to the cylinder 10. The space between the cylinder 10, top disk 12 stub 13 and bottom disk 14 forms the reference ionization chamber R, closed off from ambient atmosphere almost completely except for a tiny gap between the bottom disk 13 and the cylinder 10. Air flow is further impeded by the presence of the bottom plate 11. The annular, ring-shaped region between the cylinder 10 and the solid wall 15 of the housing forms the bipolar ionization chamber B. Air can penetrate into chamber B only by the detour through chamber U, which is closed off by mesh or grid 16. This circuitous path of air flow into the chamber B prevents direct transverse air flow therethrough and brakes or slows any air currents. The electrodes of the ionization chambers U, B, R are connected to a utilization circuit which is similar to that of FIG. 2 and need not be described again. The ionizing substance is applied centrally to the disk electrode 20 in chamber U, and to both sides of the cylinder 10 which also forms one of the electrodes for the chamber B. The disk 14, of metal, forms the other electrode of the reference chamber, as is clearly apparent from FIG. 3. An additional metal disk 17 is located interiorly of chamber R, connected to the control electrode of transistor T1.

Embodiment of FIG. 4: The threshold and alarm circuit of FIG. 4 is similar to that of FIGS. 2 and 3. An essentially closed, or smoke rejecting reference ionization chamber R is located in the lower portion of the sensor, made of a plastic box, for example cylindrical. The upper portion of the sensor is sub-divided into one sector which is essentially open to the atmosphere, so that it can include the open, unipolar ionization chamber U; next to it is a relatively closed bipolar ionization chamber B. Looked at from the top, the chambers U, B are each semicircular, mounted on the cylindrical housing 21. The chamber of the unipolar sensor U is defined by a semicylindrical mesh or screen 26, closed off at the top. The other half of the sensor enclosing the bipolar chamber B is defined by a semicylindrical housing wall 25, with a central partition 25'. A slit with a reentrant baffle extends at least in part circumferentially about the cylinder, as seen at 28.

Uniformity of sensitivity of the ionization sensor, and independence of flow direction of smoke and fire aerosols are obtained by again subdividing the sensing chambers U, B; a top view of a double subdivided chamber is seen in FIG. 4*a*, to form four ionization chambers, located in quadrants above the reference chamber. The unipolar ionization chambers and the bipolar chambers are diametrically opposite each other, so that unipolar and bipolar chambers, respectively, are located alternately next to each other. A finer subdivision than four sectors may be made, for example six or eight. It is also possible to place the bipolar ionization chamber centrally of the unipolar chamber, as seen in the top view of a sensor arrangement in FIG. 4*b*, in which the outer chamber U is formed as a cylindrical mesh, similar to mesh 16 (FIG. 3) to include, centrally therein, the bipolar chamber B in a concentric location. The shield or baffle which defines the bipolar chamber B can be formed with slots or openings shaped similarly to opening 28 (FIG. 4). Both FIGS. 4*a* and 4*b* are highly schematic. The arrangement of FIG. 4*b* makes the sensor essentially independent of direction of air flow, or flow of aerosols towards the sensor.

Various changes and modifications may be made, and features described in connection with any one of the embodiments may be used with any one of the others, within the scope of the inventive concept.

I claim:

1. Ionization-type fire sensor to supervise a predetermined space for the presence of fire or smoke therein comprising means forming a first, bipolar ionization chamber (B) which changes its electrical resistance upon change of concentration of smoke or fire aerosols in the atmosphere in said space, having a first pair of spaced electrodes and bipolar ion generating means in said chamber to ionize the atmosphere in said space which penetrates said chamber, said bipolar ion generating means being positioned with respect to said first electrode pair to result in ions of both positive and negative polarity in essentially the entire space between said first pair of electrodes to provide an ion current flow between the electrodes of the pair generated essentially by ions of both said polarities upon application of a potential between said first pair of electrodes said means defining the chamber forming a baffle means (15, 25) to prevent direct flow of stream of atmosphere in said space through said chamber and to slow or brake such flow there across;

means forming a second unipolar ion chamber (U) changing its electrical resistance upon change of concentration of smoke or first aerosols in the atmosphere in said space having a second pair of spaced electrodes and unipolar ion generating means in said chamber to ionize atmosphere in said space penetrating said chamber, said unipolar ion generating means being positioned with respect to said second spaced pair of electrodes to result in ions of only one polarity in at least a portion of the space between said second pair of electrodes to provide for ion current flow between the electrodes of said second pair of electrodes essentially generated by ions of a single polarity upon application of a potential between said second pair of electrodes, said means defining said second, unipolar chamber being formed with apertures (16, 26) to permit direct flow or stream of atmosphere into and through the space defined by said chamber;

a reference ionization chamber means (R) having two separate inputs, each input being connected to a respective ionization chamber (U, B);

a common support (11, 21) for said first, bipolar ionization chamber (B), said second, unipolar ionization chamber (U) and said reference ionization chamber means (R);

and a utilization sensing and threshold circuit means comprising two threshold circuits, each threshold circuit being connected to a respective junction between the respective ionization chamber and the respective reference ionization chamber, the threshold circuits sensing change in resistance of either, or both said chambers and providing an output signal when the resistance of at least one of said chambers rises above a predetermined threshhold level.

2. Sensor according to claim 1, wherein said utilization sensing and threshold circuit comprises first and second threshold circuits (T1, T2), each having its input connected to a respective one of said chambers (B, U) and sensing change in resistance value of the respectively connected chamber above a predetermined threshold value, an OR-gate (OR) connected to the outputs of said threshold circuits, and an alarm circuit (S) connected to the output of the OR-gate and providing an alarm when either of said threshold circuits senses that the resistance of the associated, connected chamber (B or U) rises above the predetermined associated threshold value.

3. Sensor according to claim 1, wherein the utilization sensing and threshold circuit means includes a disjunctive logic circuit (OR).

4. Sensor according to claim 1, wherein the baffle means of the first, bipolar chamber (B) comprises a shield formed with apertures to permit ingress of atmosphere into the chamber formed by the shield, in a sinuous or tortuous path and prevents direct air flow transversely of the chamber.

5. Sensor according to claim 1 wherein the support is subdivided to define the reference chamber (R), said first bipolar chamber (B) and said unipolar chamber (U).

6. Sensor according to claim 1, wherein the reference chamber is defined by a central structure (10, 12) located on said support (11);

the first bipolar ionization chamber surrounding said central structure, the baffle means comprises an outer shield (15) surrounding said central structure to define said first, bipolar chamber between the outer shield and the central structure;

the second, unipolar chamber (U) is located adjacent the reference ionization chamber (12) and said first bipolar ionization chamber (B), and the apertured means comprises a thin wire screen or mesh.

7. Sensor according to claim 1, wherein the reference ionization chamber (R) is located on said supoport and forms an end portion for the sensor;

and wherein said first bipolar (B) and second unipolar (U) ionization chambers are located adjacent said references ionization chamber (R), adjacent each other, and separated by a common wall.

8. Sensor according to claim 7, wherem the support, the reference ionization chamber (R) and said first and second chambers (B, U) are essentially circular, said first and second chambers (B, U) being sector-shaped.

9. Sensor according to claim 8, wherein said first and second chambers (B, U) are subdivided into first and second chamber units of respective bipolar and unipolar characteristics, and ionization chamber units of alternate bipolar and unipolar characteristics, respectively, being located adjacent each other (FIG. 4*a*).

10. Sensor according to claim 1, wherein said support defines the reference chamber (R), said first, bipolar (B) and second, unipolar (U) chambers (B, U) being located outside of and on said support forming the reference chamber (R).

11. Sensor according to claim 10, wherein the outline of said support, said reference chamber, and said first, bipolar and second, unipolar chambers is circular, said first, bipolar chamber being located concentrically within the second, unipolar chamber (U);

the apertured means defining said second, unipolar chamber (U) comprises a thin wire mesh or screen secured to said support, and said baffle means defining the bipolar chamber (B) comprises a solid sheet metal structure formed with apertures arranged on said structure to cause atmosphere entering said first, bipolar chamber to follow a sinuous or torturous path and prevent direct air flow thereacross.

12. Sensor according to claim 10 wherein the first bipolar chamber (B) is located concentrically within the second, unipolar chamber (U).

* * * * *